United States Patent [19]

Komendowski

[11] 4,055,282

[45] Oct. 25, 1977

[54] CONTAINER WITH ONE-PIECE NECK AND DISCHARGE CONTROLLER

[75] Inventor: Henry Komendowski, Des Plaines, Ill.

[73] Assignee: Automatic Liquid Packaging, Inc., Elk Grove Village, Ill.

[21] Appl. No.: 678,220

[22] Filed: Apr. 19, 1976

[51] Int. Cl.[2] ..... B65D 47/10

[52] U.S. Cl. ..... 222/421; 222/525; 222/537; 222/548; 222/553; 215/32

[58] Field of Search ..... 222/541, 421, 525, 537, 222/548, 553; 218/32, 253; 128/232, 248

[56] References Cited

U.S. PATENT DOCUMENTS

| | | | |
|---|---|---|---|
| 2,893,611 | 7/1959 | Akers | 222/541 X |
| 3,083,858 | 4/1963 | Biedenstein | 215/32 X |
| 3,187,966 | 6/1965 | Klybis | 222/541 |

FOREIGN PATENT DOCUMENTS

| | | | |
|---|---|---|---|
| 1,435,985 | 3/1966 | France | 215/32 |
| 662,029 | 4/1964 | Italy | 215/32 |

*Primary Examiner*—Robert B. Reeves
*Assistant Examiner*—Frederick R. Handren
*Attorney, Agent, or Firm*—Dominik, Knechtel, Godula & Demeur

[57] ABSTRACT

The hermetically sealed plastic container of the present invention has a body portion, a neck portion and a dispensing head all integrally formed. The containers furthermore preferably and advantageously are formed, filled and sealed in one continuous operation, automatically. The dispensing head is integrally molded with and atop the neck portion, and has an inside diameter which substantially corresponds with the outside diameter of the side wall of the neck portion so as to slidably and frictionally receive the neck portion within the dispensing head. A severable annular groove is provided between the neck portion and the dispensing head, with this annular groove being proportioned such that it can be severed by exerting a downward force on the dispensing head. Simultaneously, as the dispensing head is forcibly urged downwardly to sever the annular groove, the dispensing head is forcibly urged downwardly about the neck portion. The dispensing head has a dispensing spout formed in it, and the neck portion has at least one indentation in its side wall for providing a communicating channel between the side wall of the neck portion and the dispensing head which is in communication with the dispensing spout when the dispensing head is disposed about the neck portion. The product is dispensed from the container through the neck portion and the dispensing spout via the communicating channel between the side wall of the neck portion and the dispensing head.

19 Claims, 27 Drawing Figures

CONTAINER WITH ONE-PIECE NECK AND DISCHARGE CONTROLLER

BACKGROUND OF THE INVENTION

This invention relates to improved hermetically sealed plastic containers which can be formed, filled and sealed in one continuous operation. More particularly, the invention relates to such containers which have a dispensing head integrally formed on them that can be manually manipulated to an open position to dispense a product from the container and to a closed position to effectively reseal the container to preserve the product and to prevent the product from being inadvertently or accidentally dispensed or spilled.

Many various different types of blown plastic bottles presently are available, however, most of them are hermetically sealed by means of an end closure or cap which is removed by severing with a knife or the like. Once severed, the bottle remains open since there is no provision made for reclosing or resealing the bottle. Still others have threads integrally formed on a neck portion thereof, and a separate cap is provided for closing or sealing the bottle by threading the cap onto the threaded neck portion. There are also others which are formed with so-called pop tops which are integrally formed with the containers, and which can be removed without the necessity of any cutting means for severing the top from the container. Also, these tops can be used to reseal the container, once the container has been opened.

SUMMARY OF THE INVENTION

Generally, the hermetically sealed plastic container of the present invention has a body portion, a neck portion and a dispensing head all integrally formed. The containers furthermore preferably and advantageously are formed, filled and sealed in one continuous operation, automatically. The dispensing head is integrally molded with and atop the neck portion, and has an inside diameter which substantially corresponds with the outside diameter of the side wall of the neck portion so as to slidably and frictionally receive the neck portion within the dispensing head. A severable annular groove is provided between the neck portion and the dispensing head, with this annular groove being proportioned such that it can be severed by exerting a downward force on the dispensing head. Simultaneously, as the dispensing head is forcibly urged downwardly to sever the annular groove, the dispensing head is forcibly urged downwardly about the neck portion. The dispensing head has a dispensing spout formed in it, and the neck portion has at least one indentation in its side wall for providing a communicating channel between the side wall of the neck portion and the dispensing head which is in communication with the dispensing spout when the dispensing head is disposed about the neck portion. The product is dispensed from the container through the neck portion and the dispensing spout via the communicating channel between the side wall of the neck portion and the dispensing head.

Other features of the container of the present invention relate to a twist off cap which is provided on the dispensing head, for normally sealing the dispensing spout. To open the container, after the dispensing head has been forced downwardly about the neck portion, the twist off cap is manually manipulated to sever it from the dispensing head to thereby provide an opening or orifice at the end of the dispensing spout from which a product can be dispensed.

Still another feature, according to one embodiment, permits the dispensing head to be manually rotated to open and close the container, and according to another embodiment, permits the dispensing head to be manually pushed and lifted to open and close the container.

In accordance with still another feature of the invention, a secondary sealing means can be provided for effectively resealing the open end of the dispensing spout.

A still further feature of the invention is the provision of means to prevent fluid from being withdrawn into the container during use.

Accordingly, it is the object of the present invention to provide improved hermetically sealed plastic containers which can be formed, filled and sealed in one continuous operation, automatically.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF A PREFERRED EMBODIMENT

Figure 1:
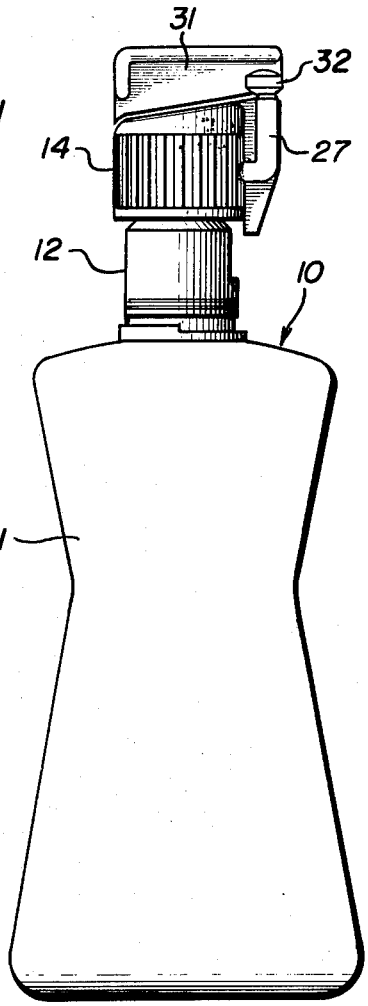
FIG. 1 is a side plan view of a plastic container exemplary of the present invention.
Figure 2:
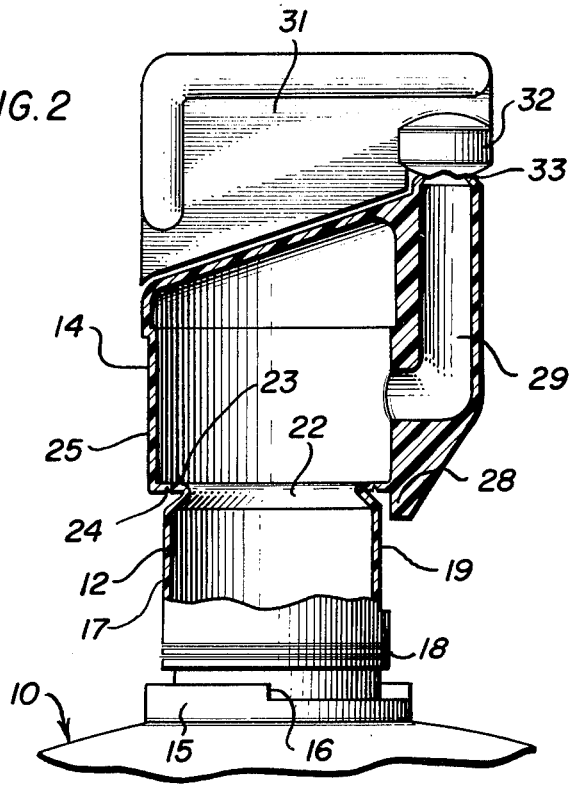
FIG. 2 is a partial side plan view of the container of FIG. 1, partially sectionalized to better illustrate the manner in which it is formed.

In U.S. Pat. No. 3,325,860, to Gerhard Hansen, there is disclosed apparatus for blowing, filling and hermetically sealing bottles. Generally, the disclosed apparatus includes an extruder, a two-piece mold having two mold halves, a holding jaw including two jaw halves, a head jaw including two jaw halves, a cutting apparatus, and a composite filling and blowing tube. Reference can be made to the subject patent for a full and detailed description of the apparatus, however, its operation is generally as follows. A parison in the form of a hollow tube is extruded by the extruder between the mold halves. When the parison or tube is of the required length, the mold halves are closed. The lower end of the tube is pinched closed by the mold, and its upper end is positioned and held by the holding jaws, through the applicaton of vacuum applied thereto, and is separated by the cutting apparatus, which may be a heated wire. A mold carriage moves the mold, the holding jaw and the head jaw into position for shaping, filling and sealing the bottle.

To fill the bottle, the mandrel of the composite filling and blowing and vent tube moves into the conical neck of the parison, and the hot plastic tube or parison is inflated by a burst of compressed air and pressed against the walls of the mold. At the same time, a precisely metered quantity of the product being bottled fills the bottle via a filling channel in the mandrel by a precise metering machine. The air used for inflating or blowing the bottle is discharged to the outside through an air discharge duct. As soon as the product hits the plastic walls, the bottle solidifies.

The mandrel is raised, and the jaw halves of the head jaw are closed by means of two cylinders. The head jaw forms and seals the upper bottle head and thereafter the mold, the head jaw and the holding jaw all open. The filled and hermetically sealed bottles leave the apparatus via a bottle dropout chute.

The entire operation takes about as much time as the conventional blow molding of an empty plastic bottle, hence it is apparent that numerous advantages are provided. The complete packaging cycle can be kept sterile so that the system can be used in the pharmaceutical industry as well as in other industries to package or bottle items such as fruit juices, edible oils, vinegar, milk, laundry or dishwashing detergents, floor care liquids, cleansers, dyes, machine oils, bubble baths and shampoos, to mention but a few of the whole host of items which can be bottled. Many thermoplastic materials can be used including low and high density polyethylene, including MPEP 212 polyethylene produced by Monsanto, polypropylene, polycarbonate acetate, and GEON and ABS, so that virtually any type of flowable product can be packaged or bottled, in a compatible material.

Correspondingly, similar apparatus is disclosed in U.S. Pat. No. 3,597,793, for blowing, filling and hermetically sealing bottles having end closures such as caps which can be easily removed and thereafter used to reclose or reseal the bottles.

The apparatus as well as the methods disclosed in the above-identified U.S. Pat. Nos. 3,325,860 and 3,597,793 are exemplary of the apparatus and the methods which can be used to form the containers of the present invention. While, as indicated, it is preferable to blow, fill and hermetically seal the containers in a continuous operation, automatically, in the manner disclosed in the subject patents, it would be obvious from the description below that the containers can be formed and subsequently filled, if desired. However, far greater advantages are realized by forming them in the manner disclosed in these prior patents.

Referring now to the drawings, in FIGS. 1–5, there is illustrated a container 10 exemplary of the present invention, the container including a body portion 11, a neck portion 12, and a dispensing head 14. As indicated above, the container 10 preferably and advantageously, is blown, filled and hermetically sealed, all in one continuous operation, automatically. While the body portion 11 of the container 10 is illustrated to be of a particular configuration, it will be realized that the body portion can be of any one of a various number of different configurations.

The neck portion 12 is integrally formed with the body portion 11 of the container 10, and the dispensing head 14 is integrally formed with and atop of the neck portion 12, as illustrated. The neck portion 12 advantageously is provided with an annular stop ring 15 which, in the illustrated embodiment, is formed therewith at the juncture between the body portion 11 and the neck portion 12. As can be best seen in FIGS. 2 and 3, the annular stop ring 15 is formed with a stepped configuration which extends annularly about the neck portion 12 so as to provide a pair of shoulders or stops 16 which will permit the dispensing head to be rotated, for example, 90°, for reasons set forth more specifically below. The side wall 17 of the neck portion 12 is of a predetermined or pre-established diameter, and annular ribs 18 are provided on the lower part thereof, spaced slightly above the annular stop ring 15. The side wall 17 also has an indentation 19 which, in the illustrated embodiment, is in the form of a flat surface formed on the side wall 17 of the neck portion, for reasons set forth more specifically below. The upper edge 22 of the neck portion 12, in the illustrated embodiment, is formed generally conical shaped, and merges and joins with a generally horizontal bottom wall or flange 23 of the dispensing head 14. The horizontal bottom wall or flange 23, at the juncture with the conical top portion 22 of the neck portion 12 is provided with an annular groove 24, the same being formed and provided in generally the same fashion as disclosed in the above-mentioned U.S. Pat. No. 3,597,793. This annular groove 24 is proportioned so that it can be severed by exerting a downward force on the dispensing head 14, as more fully described below.

The dispensing head 14 is integrally formed with and atop the neck portion 12, generally as described above, and has a side wall 25 which has an interior diameter which is formed to substantially correspond with the outside diameter of the side wall 17 of the neck portion 12, so that the neck portion 12 can be slidably and frictionally received within the dispensing head 14, and the lower portion of the laterally extending projection 27 extends slightly below the horizontal bottom wall or flange 23 so as to provide a stop 28 which is engageable with the stops 16 on the annular stop ringe 15, when the neck portion 12 is disposed within the dispensing head 14. A dispensing port of channel 29 which, in the illustrated embodiment, is generally L-shaped, is provided in the laterally extending projection 27, and its lower end is opened to the interior of the dispensing head 14. The top wall 30 of the dispensing head, in the illustrated embodiment, is a tapered surface, however, the top wall 30 can assume any one of a number of various different configurations.

A twist off cap 31 is integrally formed atop the top wall 30 of the dispensing head 14. This twist off cap 31 has a bulb-like portion 32 which is formed atop of and normally closes the upper end of the dispensing port or channel 29. An annular groove 33 is formed at the juncture between the bulb-like portion 32 and the dispensing port 29, which annular groove 33 like the annular groove 24 is proportioned to be severed when the twist off cap 31 is manually twisted or manipulated.

The container 10 is blown, formed, filled and sealed, and subsequently shipped for ultimate use by a consumer, with the dispensing head 14 formed with and atop the neck portion 12, as illustrated in FIG. 1. As indicated above, in this respect, the container 10 can be formed with apparatus as disclosed in the above-mentioned U.S. patents.

Figure 3:
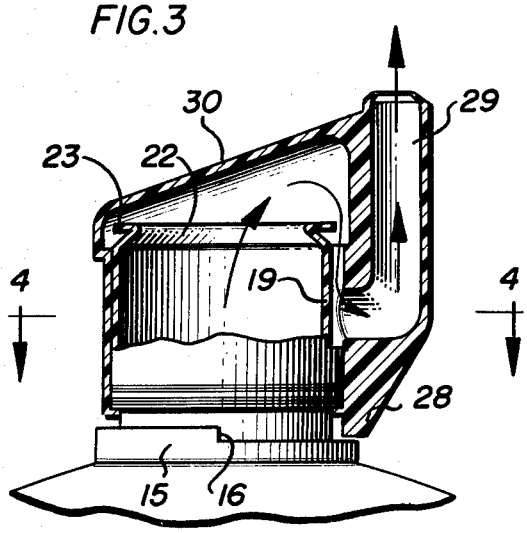
FIG. 3 is a partial side plan view of the container of FIG. 1, partially sectionalized, illustrating the manner in which a product is dispensed from the container.

In order to use the container 10, i.e., to dispense a product from the container 10, a consumer initially asserts a downward force on the dispensing head 14 to sever the annular groove 24 and to slidably and forcibly urge the dispensing head 14 down onto and about the neck portion 12 of the container, generally as illustrated in FIG. 3. While the interior diameter of the side wall 25 and the outside diameter of the side wall 17 are proportioned so that they substantially correspond and form a tight seal when the dispensing head is disposed about the neck portion 12, the annular ribs 18 about the neck portion 12 provided additional sealing so as to prevent product leakage.

In the embodiment illustrated in FIGS. 1–5, when the dispensing head 14 is forcibly urged downwardly about the neck portion 12 of the container, it may be noted that the indentation 19 provides a communicating channel between the side wall 17 of the neck portion 12 and the side wall 25 of the dispensing head 14, which is in communication with the dispensing spout 29 in the laterally extending projection 27. At this time, or alternatively, prior to forcibly urging the dispensing head downwardly about the neck portion 12 of the container 10, the twist off cap 31 is manually manipulated to sever the bulb-like portion 32 from atop the end of the dispensing port 29, by simply twisting it, to provide an opening or orifice into the dispensing spout 29 for discharging a product from the container.

As illustrated in FIG. 3, with the dispensing head 14 in the position illustrated and the twist off cap 31 having been removed, a product can be dispensed from the container by expelling it through the neck portion 12, the communicating channel 35, into and through the dispensing port 29. The product can be dispensed by inverting the container 10 or, if the container is of the flexible type and the product is sufficiently viscous, by simply tilting and squeezing the container 10 to expel the product, in the described fashion.

Figure 4:
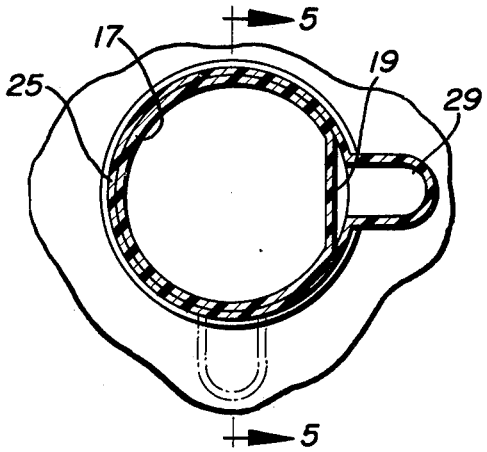
FIG. 4 is a sectional view taken along lines 4—4 of FIG. 3.
Figure 5:
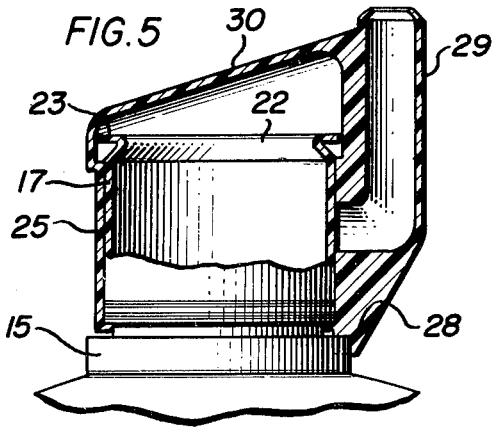
FIG. 5 is a sectional view taken along lines 5—5 of FIG. 4.

To close or reseal the container 10, the dispensing head 14 is simply rotated 90°, to engage the stop 28 on the laterally extending projection 27 with the stop 16 on the annular stop ring 15 on the neck portion 12, as illustrated in FIGS. 4 and 5. In this position, as can be seen, the opening to the dispensing spout 29 in the dispensing head 14 is effectively sealed or closed by the side wall 17 of the neck portion 12. Accordingly, no product can flow out of the neck portion 12 into the dispensing spout 29. When it is again desired to dispense a product from the container, the dispensing head 14 is again rotated 90° in the opposite direction to engage the other one of the stops 16, in which position the open end of the dispensing spout 29 is aligned with the indentation 19 in the side wall 17 of the neck portion 12, so as to again provide the communicating channel 35 through which the product can be dispensed.

Figure 6:
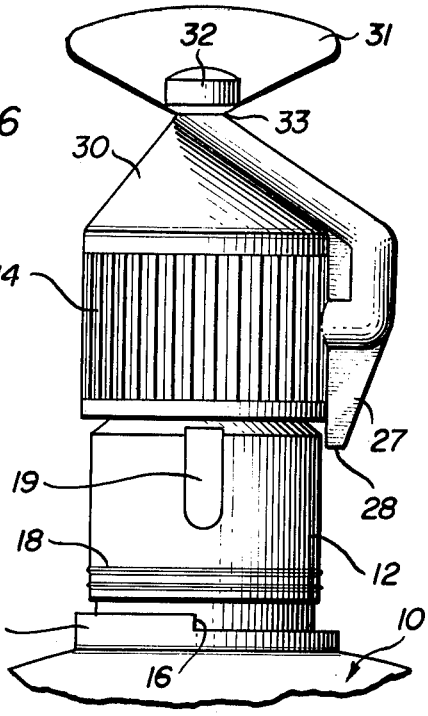
FIG. 6 is a partial side plan view of the upper portion of a container exemplary of the present invention, illustrating still another arrangement of the dispensing head integrally formed on the container.
Figure 7:
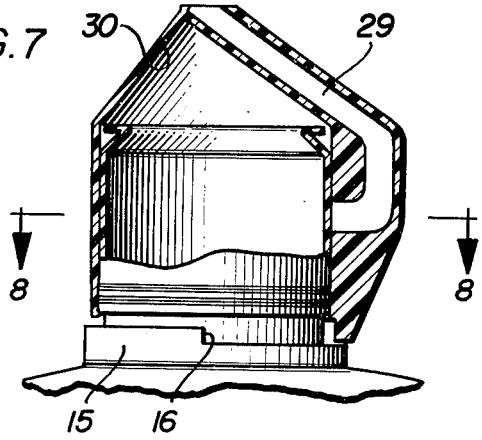
FIG. 7 is a partial side plan view of the container of FIG. 6, partially sectionalized to illustrate the manner in which a product is dispensed from the container.
Figure 9:
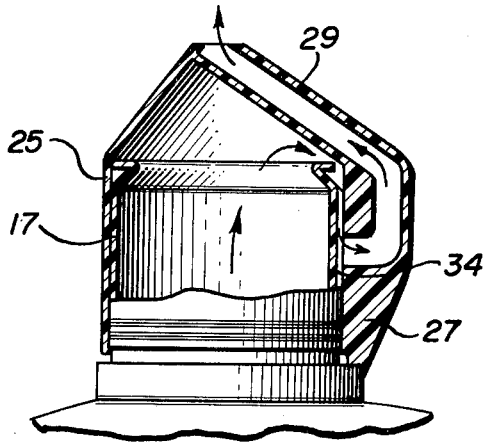
FIG. 9 is a sectional view taken along lines 9—9 of FIG. 8.
Figure 8:
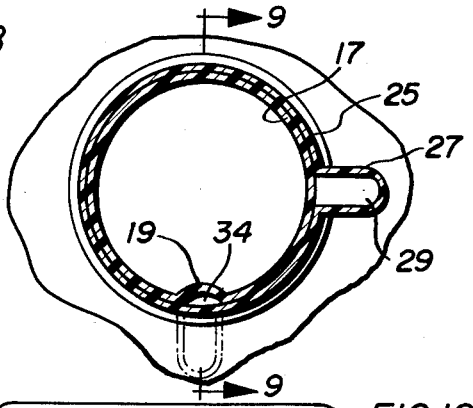
FIG. 8 is a sectional view taken along lines 8—8 of FIG. 7.

In FIG. 6, there is illustrated still another container exemplary of the invention, having a neck portion 12 and a dispensing head 14 formed with and atop of it, in the manner described above. In this case, however, the neck portion 12 is provided with a generally concave shaped indentation 19 which provides a communicating channel 34, as described above. The arrangement also is such that the dispensing spout 29 in the laterally extending projection 27 on the dispensing head 14 is sealed by the side wall 17 of the neck portion 12, when the dispensing head 14 is forcibly urged downwardly about the neck portion 12, in the manner described above, as illustrated in FIGS. 7 and 8. In order to dispense a product from the container, the dispensing head 14 is rotated 90° to engage the stop 28 on the laterally extending projection 27, with the stop 16 formed on the annular stop ring 15, as illustrated in FIG. 9.

Also, in this case, the top wall 30 of the dispensing head 14 is illustrated to be generally conical shaped, with the dispensing spout 29 being of a generally U-shaped configuration, so as to extend angularly to the apex of the conical shaped top wall 30 of the dispensing head 14. Again, an opening or orifice into the dispensing spout 29 is provided by manually twisting the twist off cap 31 to sever the annular groove 33.

Figure 10:
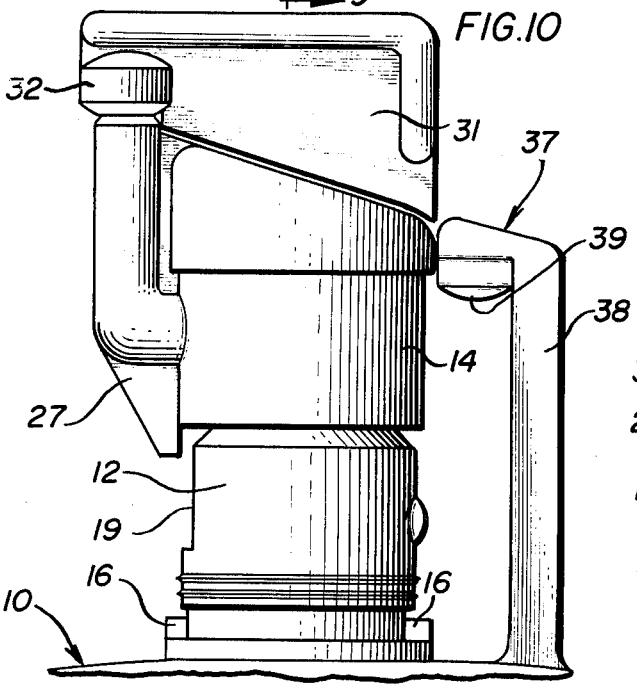
FIG. 10 is a partial side plan view of the upper end of a container exemplary of still another embodiment of the invention, the container having a secondary closure integrally formed therewith.
Figure 11:
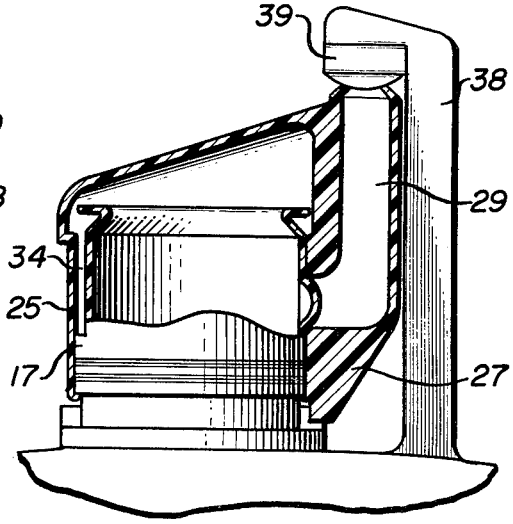
FIG. 11 is a partial side plan view of the container of FIG. 10, partially sectionalized, illustrating the manner in which the dispensing spout in the dispensing head is closed by means of the secondary closure.
Figure 12:
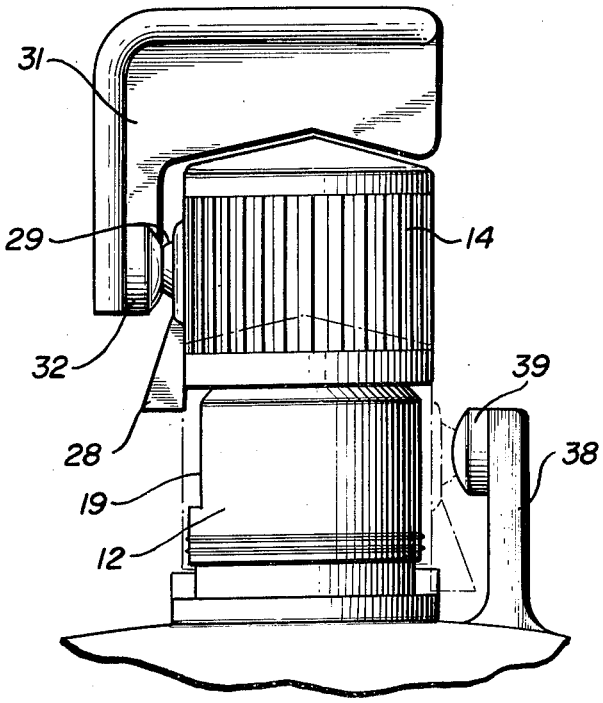
FIGS. 12–17 each generally illustrate various orientations of the dispensing spout on the dispensing head.

In FIGS. 10 and 11, there is illustrated still another container exemplary of the present invention, having a neck portion 12 and a dispensing head 14 formed with and atop the neck portion 12. In this case, the dispensing spout 29 in the laterally extending projection 27 on the dispensing head 14 normally is opened at its lower end when the dispensing head 14 is forcibly urged downwardly about the neck portion 12 of the container. An opening or orifice through which a product can be dispensed from the dispensing port 29 is again provided by manually manipulating or twisting the twist off cap 31, in the manner described above.

In this case, the dispensing port or channel 29 again is sealed or closed by the side wall 17 of the neck portion 12 when the dispensing head 14 is rotated, in the manner described above, however, a secondary seal 37 is provided to seal the opened upper end of the dispensing port or channel 29. The secondary seal 37, in this case, includes a vertical stem portion 38 which terminates with a bulb-like closure 39 positioned and proportioned so as to effectively snappingly engage with the open end of the dispensing port or channel 29, as illustrated in FIG. 11. Accordingly, in this case, both the upper and lower ends of the dispensing port or channel 29 are sealed.

In FIGS. 12–17, there are illustrated various other configurations and arrangements for the dispensing port or channel 29 in the dispensing head 14 of the containers. For example, in FIG. 12, the dispensing port 29 extends laterally outwardly of the side wall of the dispensing head 14. Also, a secondary seal 37 again is provided for sealing the open end of the dispensing port 29. In this case, the secondary seal again comprises a vertical stem 38 which is integrally molded with the container, the same having a bulk-like closure 39 projecting laterally outwardly so as to snap actingly engage within the open end of the dispensing port 29.

Figure 13:
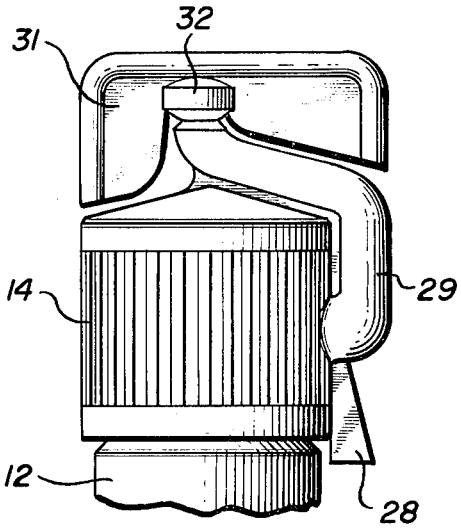
Figure 14:
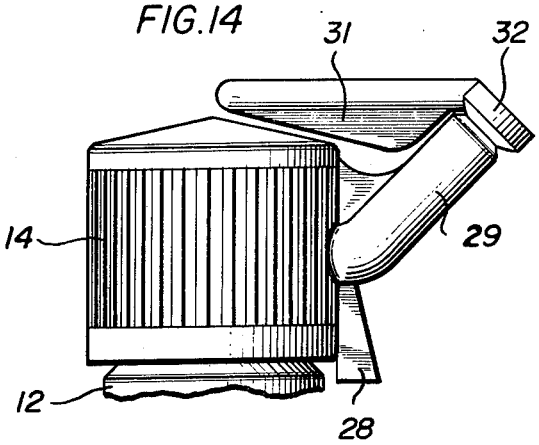
Figure 15:
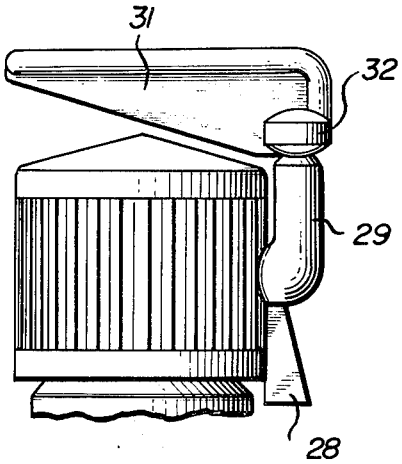
Figure 16:
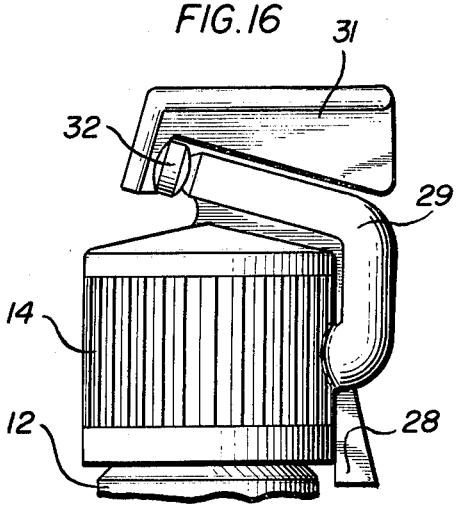
Figure 17:
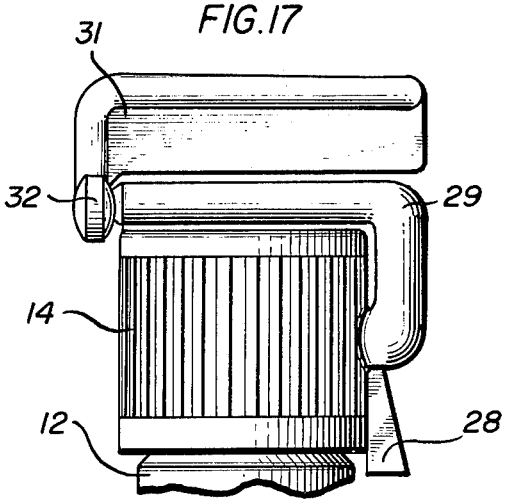

In FIG. 13, the dispensing port 29 is disposed generally in the same fashion as illustrated in FIG. 6, however, in this case, a differently configured twist off cap 31 is provided. In FIG. 14, the dispensing port 29 extends annularly outwardly and upwardly from the side wall of the dispensing head 14 and, in FIG. 15, the open end of the dispensing port projects vertically upwardly. Again, also, differently configured twist off caps 31 are provided. In FIGS. 16 and 17, the dispensing ports 29 are disposed so as to extend upwardly and over the top wall of the dispensing head 14, in a direction opposite to which it extends from the side wall of the dispensing head 14, so as to dispense a product in an opposed direction. While numerous different configurations are illustrated, it will be apparent that still other configurations are possible, depending upon a particular need or desire. Accordingly, the specific construction of the dispensing port 29 of the dispensing had 14 is not critical as far as the present invention is concerned.

Figure 18:
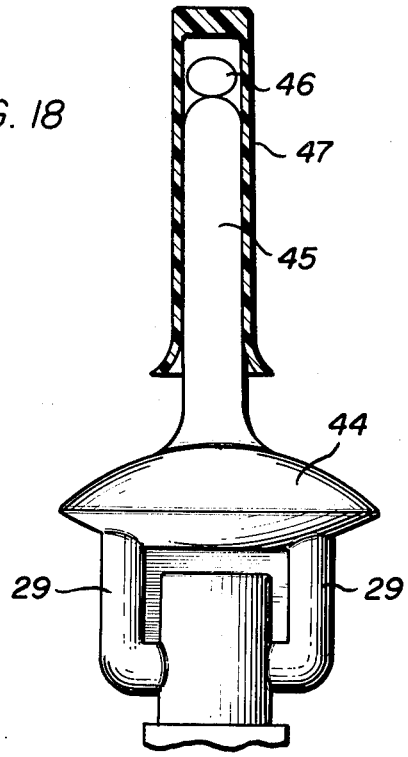
FIG. 18 is a partial side plan view of the upper portion of a container, the container being of a type which is usable for giving an enema.
Figure 19:
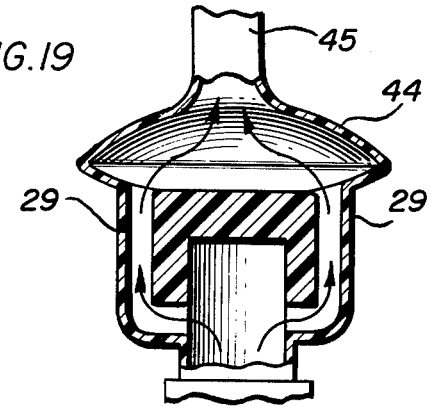
FIG. 19 is a partial side view of the container of FIG. 18, partially sectionalized to illustrate the manner in which a product is dispensed from the container.
Figure 20:
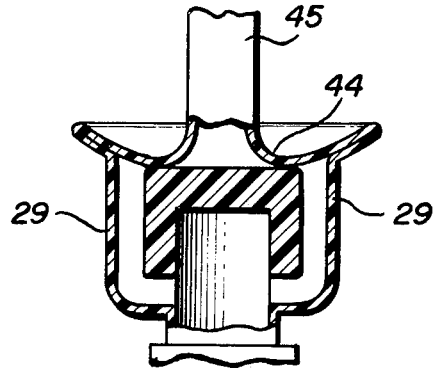
FIG. 20 is a side plan view of the container of FIG. 18, partially sectionalized to illustrate the manner in which the dispensing spouts are sealed to prevent a product from being withdrawn into the container.

In FIGS. 18–20, there is illustrated still another container which in this case is a container adapted for use in giving enemas. The dispensing head, in this case, includes a pair of dispensing ports 29, which are laterally disposed with respect to one another and which open into a bellows 44. A nozzle 45 of an elongated construction is attached to the bellows 44, and the nozzle is normally closed with a twist off cap 46. An overcap 47 can be provided for the nozzle 45.

In utilizing the container illustrated in FIGS. 18–20, the twist off cap 46 again is removed to provide an orifice into the nozzle 45. Thereafter, the product is dispensed through the dispensing ports 29, the bellows 44 and through the nozzle 45. Upon insertion of the nozzle 45, premature dispensing of the product is prevented by the force exerted on the bellows 44 during insertion, which force collapses the bellows 44, as illustrated in FIG. 20, to effectively seal the one end of each of the dispensing ports 29 in he dispensing head 14. After the nozzle has been inserted and the insertion pressure released, the open end of the dispensing portions 29 again are opened so that the product can be dispensed through the dispensing ports.

Figure 21:
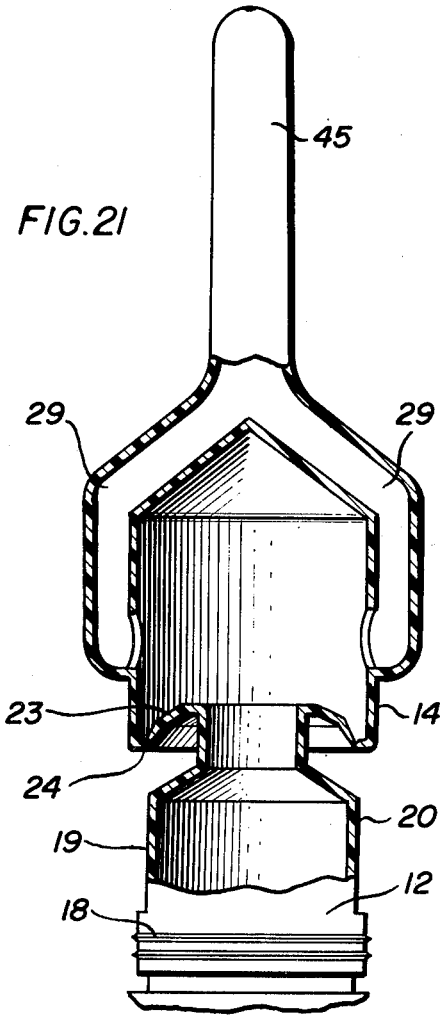
FIG. 21 is a partial side plan view of still another container exemplary of the invention, this container also being of the type usable for giving an enema.
Figure 22:
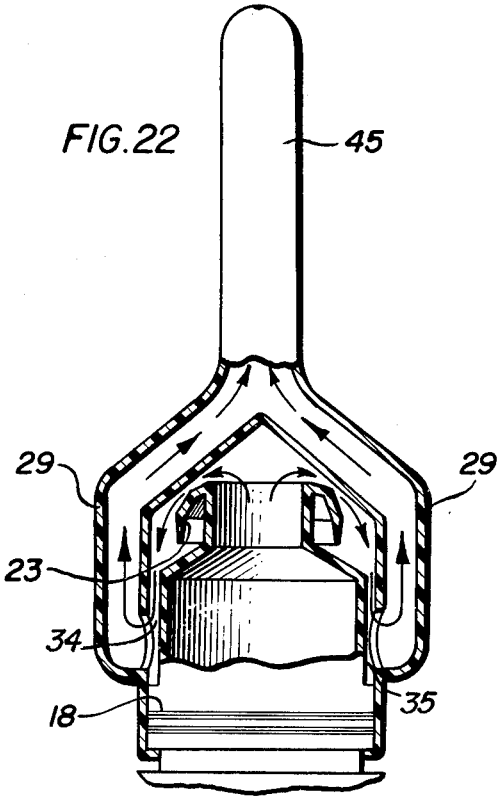
FIG. 22 is a partial side plan view of the container of FIG. 21, partially sectionalized to illustrate the manner in which a product is dispensed from the container and also illustrating the manner in which a product is prevented from being withdrawn into the container.

In FIGS. 21 and 22, there is illustrated still another container which like the container illustrated in FIGS. 18–20, is usable for the purpose of giving enemas. In this case, the dispensing head 14 has a horizontal bottom wall of flange 23 which generally tapers upwardly in a conical fashion, the same terminating and joining with a reduced diameter portion of the neck portion 12. An annular groove 24 is provided in the horizontal bottom wall or flange 23, as described above, and the interior diameter of the dispensing head 14 is proportioned to correspond with the outside diameter of the neck portion 12 so that the neck portion 12 is slidably and frictionally received within the dispensing had 14. the neck portion 12 has two oppositely disposed indentations 19 and 20 which provide communicating channels 34 and 35 from the neck portion 12 to the dispensing ports 29 of the dispensing head 14, as described above.

The dispensing head 14, in this case, has two oppositely disposed dispensing ports 29 which merge with the orifice in a nozzle 45, and which are disposed to align with the indentations 19 and 20 of the neck portion 12, when the dispensing head 14 is forcibly urged downwardly about the neck portion 12.

To utilize the container illustrated in FIGS. 21 and 22, the dispensing head 14 is forcibly urged downwardly about the neck portion 12 of the container, in the manner described above. In doing so, the openings to the dispensing ports 29 of the dispensing head 14 are aligned with the indentations 19 and 20 provided on the neck portion 12 so as to provide communicating channels 34 and 35 between the side wall 17 of the neck portion 12 and the side wall 25 of the dispensing head 14. Since the interior diameter of the side wall 25 of the dispensing head 14 substantially corresponds to the outside diameter of the side wall 17 of the neck portion 12, the neck portion is slidably and frictionally received within the dispensing head 14 and thereby provides a seal between the neck portion 12 and the dispensing head 14. In addition, annular ribs 18 are provided on the neck portion 12 to provide an additional seal for preventing leakage.

In dispensing a product from the container of FIGS. 21 and 22, the product is expelled through the neck portion 12, the communicating channels 34 and 35 and into and through the dispensing channels 29, through the nozzle 45, as generally illustrated in FIG. 22. The horizontal bottom wall or flange 23 of the dispensing head 14 provides a flap or diaphragm which is pivotal, as illustrated in FIG. 22, so as to effectively prevent a product from being withdrawn into the container when the pressure which is exerted on the container to expel the product from the container is released. In other words, when the product is being expelled from the container, the product flows through the neck portion 12, past the flap or diaphragm provided by the horizontal bottom wall or flange 23, through the communicating channels 34 and 35, into the dispensing ports 29. When the pressure exerted on the container to expel the product from the container is released, any product which tends to flow back into the container causes the flap or horizontal bottom wall or flange 23 to pivot upwardly against the top wall 30 of the dispensing head 14, thus effectively sealing or closing the passageway back into the neck portion 12 of the container.

Figure 23:
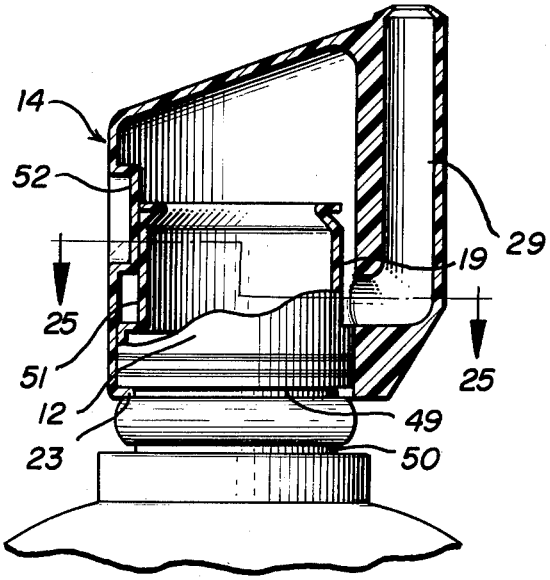
FIG. 23 is a partial side plan view of the upper end of a container, partially sectionalized, illustrating a push-pull type of dispensing head, with the dispensing head shown in an open position for dispensing a product.
Figure 24:
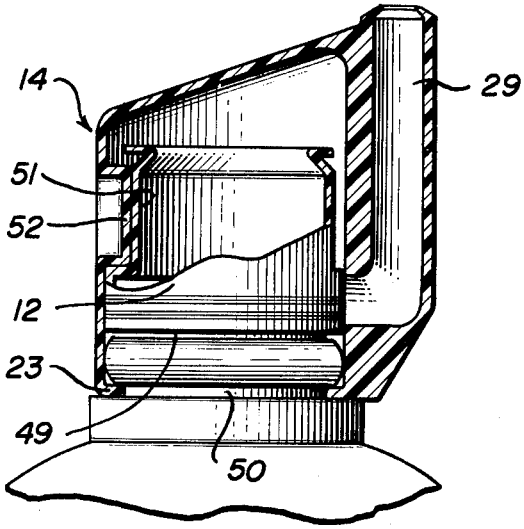
FIG. 24 is like FIG. 23, with the dispensing head shown in a closed position.
Figure 25:
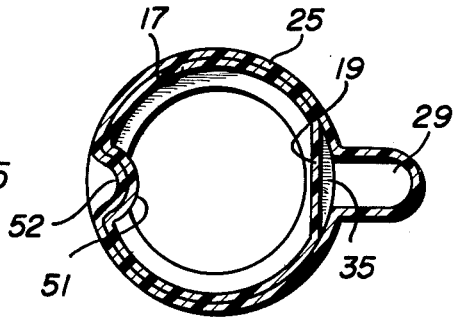
FIG. 25 is a sectional view taken along lines 25—25 of FIG. 23.

In FIGS. 23–25, there is illustrated still another container which is generally like the container of FIG. 1 but, in this case, the dispensing head 14, after being severed and forcibly urged down about the neck portion 12, is pulled or raised to open the container to dispense a product and is pushed down to close the container.

More particularly, as can be seen in FIGS. 23 and 25, when the dispensing head 14 is forcibly urged downwardly about the neck portion 12 of the container, the opening to the dispensing port 29 of the dispensing head 14 is aligned with the indentation 19 provided on the neck portion 12 so as to provide a communicating channel 35 between the side wall 17 of the neck portion 12 and the side wall 25 of the dispensing head 14. The neck portion 12 is provided with a pair of spaced apart annular grooves 49 and 50, into which the horizontal bottom wall flange 23 snap-actingly engages, as the dispensing head 14 is slidably vertically displaced with respect to the neck portion 12. These grooves 49 and 50 are spaced such that a product can be dispensed from the container when the flange 23 is engaged with or disposed within the groove 49, as illustrated in FIG. 23. When the dispensing head 14 is forcibly urged further downwardly about the neck portion 12, and the flange 23 engages with or is disposed within the groove 50, the opening into the dispensing port or channel 29 is sealed by the side wall 17 of the neck portion 12, as illustrated in FIG. 24.

Accordingly, it can be seen that the dispensing head 14 can be manually manipulated in a pull-push type operation to open and close the container, with the dispensing head 14 being located and positioned to dispense a product when the dispensing head 14 is pulled upwardly until the flange 23 engages within the groove 49. When it is desired to again close the container, the dispensing head 14 is pushed downwardly until the flange 23 engages within the groove 50. In this position, the opening to the dispensing port 29 is sealed by the side wall 17 of the neck portion 12 thus preventing any product from flowing from the container into the dispensing port 29. The flange 23 when engaged within the groove 50 effectively prevents the dispensing head 14 from being accidentally positioned to permit a product to be inadvertently dispensed, since some positive force or action must be exerted of the dispensing head 14 to disengage the flange 23 from the groove 50.

Since the dispensing head 14 is manipulated in a pull-push type operation, preferably and advantageously cooperative guide means are provided on the neck portion 12 of the container and on the dispensing head 14 to prevent the latter from being rotated with respect to the neck portion 12, such that the opening into the dispensing port 29 becomes displaced or misaligned with the communicating channel 35. In the illustrated embodiment, these guide means are in the form of a vertically disposed key way 51 formed in the neck portion 12, and a correspondingly formed cooperative key 52 on the dispensing head 14 which is slidably disposed within the key way 51. Other types of guide means also can be provided, if desired.

Figure 26:
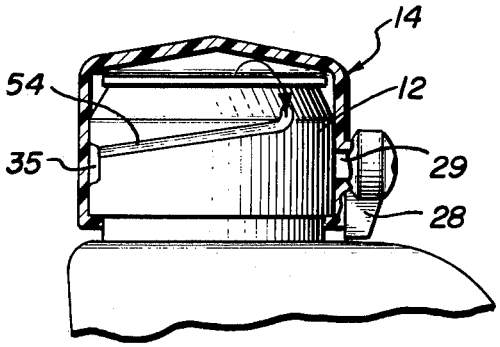
FIG. 26 is a partial side plan view of the upper end of a container, partially sectionalized, illustrating a dispensing head and channel for a controlled flow of the product in dispensing the product for the container.
Figure 27:
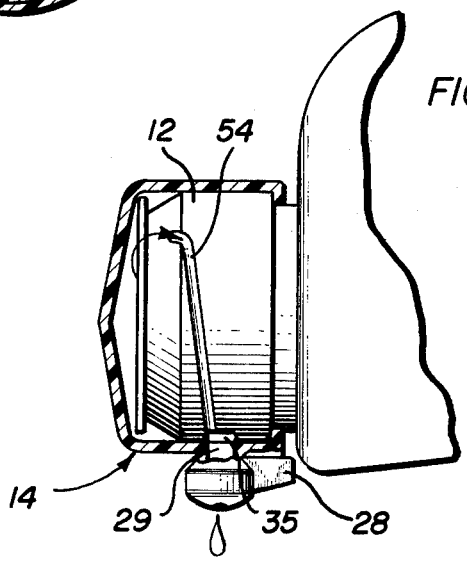
FIG. 27 is like FIG. 26 illustrating the manner in which the product is dispensed from the container.

In FIGS. 26 and 27, there is illustrated still another container having a dispensing head 14 which is forcibly urged downwardly about the neck portion 12 of the container, as described above. In this case, the flange 23 engages within an annular groove in the neck portion 12 to secure the dispensing head to the neck portion and in a fashion such that the dispensing head 14 is rotatable to align the dispensing portion 29 with the communicating channel 35, all as generally described above. Should stops such as those illustrated in FIGS. 1–5 can be provided and positioned to be engaged by the stop 28, to provide indications when the dispensing head 14 is properly positioned to align the dispensing port 29 with the communicating channel 35 to dispense a product, and when in a closed position.

The dispensing port 29 is disposed such that the product is dispensed from the side of the dispensing head, and initially can be sealed with a twist-off cap (not shown) such as illustrated in FIG. 1. Also, in the illustrated embodiment, the product flows from the container through a channel 54 which is of a pre-determined size and which extends from the open top of the container about the periphery of the neck portion 12 to the communicating channel 35. This channel 54 provides a controlled flow of the product, and preferably is proportioned such that a pressure must be exerted on the flexible container to force the product from the container through the channel 54 into the communicating channel 35. In this fashion, the product can be dispensed through the dispensing port 29 in drop form.

To dispense the product from the container, the dispensing head 14, of course, is first forcibly urged downwardly about the neck portion 12, in the manner described above, and as illustrated in FIG. 26. The dispensing head 14 then is rotated to align the dispensing port 29 with the communicating channel 35, as illustrated in FIG. 27. The container preferably is tipped on its side and squeezed to force the product from the container through the channel 54 into the communicating channel 35, from where it is dispensed through the dispensing port 29. As indicated, the product can be dispensed from the container in drop form. To close the container, the dispensing head 14 is again rotated to misalign the channel 54 with the communicating channel 35.

It will thus be seen that the objects set forth above, among those made apparent from the preceding description, are efficiently attained and certain changes may be made in the above article. Accordingly, it is intended that all matter contained in the above description or shown in the accompanying drawings shall be interpreted as illustrative and not in a limiting sense.

Now that the invention has been described, what is claimed as new and desired to be secured by Letters Patent is:

1. A hermetically sealed plastic container having a body portion, a neck portion and a dispensing head all integrally formed, a. said neck portion having a side wall which is of a predetermined outside diameter;

b. said dispensing head being integrally molded with and atop said neck portion and having an inside diameter which substantially corresponds with the outside diameter of said neck portion so as to slidably and frictionally receive said neck portion therein;

c. a severable annular groove provided between said neck portion and said dispensing head, said dispensing head being severed from said neck portion and the latter being received therein by exerting a downward force on said dispensing head to sever said annular groove and to forcibly urge said dispensing head about said neck portion;

d. a dispensing spout with an inlet opening formed in said dispensing head;

e. at least one indentation in said side wall of said neck portion for providing a communicating channel between the side wall of said neck portion and said dispensing head which is in communication with said dispensing spout when said dispensing head is disposed about said neck portion, whereby a product can be dispensed from said container through said neck portion, said communicating channel and into said dispensing spout from which the product is expelled.

2. The plastic container of claim 1, wherein said dispensing head further comprises sealing means normally sealing the terminal end of said dispensing spout, said sealing means being removable to provide an opening from said dispensing spout through which a product can be dispensed.

3. The plastic container of claim 2, wherein said sealing means comprises a twist-off cap integrally molded with said dispensing head and having a bulb-like portion normally sealing the end of said dispensing spout, an annular groove formed at the juncture of said bulb-like portion and the end of said dispensing spout proportioned to be severed when said twist-off cap is manually twisted to provide said opening.

4. The plastic container of claim 1, wherein said dispensing head is rotatable with respect to said neck portion to disalign said dispensing spout with said indentation, the side wall of said neck portion effectively sealing the inlet opening into said dispensing spout, whereby said dispensing spout is closed so as to prevent a product from being dispensed from said container.

5. The plastic container of claim 1, wherein said inlet opening into said dispensing spout normally is aligned with said indentation in said side wll of said neck portion when said dispensing head is forcibly urged downward about said neck portion, and said dispensing head is rotated to close said inlet opening into said dispensing spout.

6. The plastic container of claim 1, wherein said inlet opening into said dispensing spout normally is sealed by said side wall of said neck portion when said dispensing head is forcibly urged downwardly about said neck portion, and said dispensing head is rotated to align said dispensing spout with said indentation in said side wall to provide said communicating channel.

7. The plastic container of claim 5, wherein said neck portion and said dispensing head have cooperating stop means which are engageable when said dispensing head is rotated to align said dispensing head in said open and closed positions.

8. The plastic container of claim 6, wherein said neck portion and said dispensing head have cooperating stop means which are engageable when said dispensing head is rotated to align said dispensing head in said open and closed positions.

9. The plastic container of claim 1, wherein said indentation comprises a flat formed on said side wall of said neck portion.

10. The plastic container of claim 1, wherein said indentation comprises a concave indentation in the side wall of said neck portion.

11. The plastic container of claim 1, further comprising at least one annular rib formed on said side wall of said neck portion for providing an additional seal between said dispensing head and said neck portion to prevent leakage.

12. The plastic container of claim 1, further comprising secondary sealing means for sealing the terminal end of said dispensing spout, said secondary sealing means comprising means integrally formed with said container and positioned so as to be disposable within the open end of said dispensing spout by rotating said dispensing head to positionally align said means and the open end of said dispensing spout.

13. The plastic container of claim 12, wherein said secondary means comprises a substantially vertically disposed stem means having a bulb-like member formed on it which is positioned and proportioned to be disposable within the open end of said dispensing spout by rotating said dispensing head to align said bulb-like member and the open end of said dispensing spout.

14. The plastic container of claim 1, wherein said dispensing head comprises a bottom wall, said annular groove being formed in said bottom wall so that when severed said bottom wall forms a pivotal flap which is operable to effectively prevent a product from flowing back into said container.

15. The plastic container of claim 1, wherein said dispensing head is forcibly urged downwardly on said neck portion to a closed position whereat said dispensing spout is closed by said side wall of said neck portion, said dispensing head thereafter being forcibly urged upwardly on said neck portion to an open position whereat said dispensing spout is in communication with said communicating channel to permit a product to be dispensed, whereby the container can be opened and closed by manipulating the dispensing head in a pull-push fashion.

16. The plastic container of claim 15, further comprising a horizontal extending annular flange on said dispensing head and a pair of spaced-apart annular grooves in said neck portion proportioned to receive therein said annular flange on said dispensing head, said annular grooves defining an open and a closed position, respectively, said dispensing head being releasibly locked in said open and closed positions to open and close said container by engaging said annular flange within the respective ones of said annular grooves.

17. The plastic container of claim 16, further comprising cooperative guide means on the respective ones of said dispensing head and said neck portion for permitting said dispensing head to be raised and lowered with respect to said neck portion and for preventing said dispensing head from being rotated with respect to said neck portion.

18. The plastic container of claim 1, further comprising a channel of a controlled size formed in said neck portion and extending from the open end thereof about at least a portion of the periphery of the side wall of said neck portion to said communicating channel, whereby a product is dispensed from said container through the open end of said neck portion, through said controlled sized channel into said communicating channel from where it is dispensed through said dispensing spout.

19. The plastic container of claim 18, wherein said controlled size channel is proportioned so that said plastic container must be squeezed to force the product through said channel, whereby the product can be dispensed in drop form.

* * * * *